US009997846B1

(12) United States Patent
Salter et al.

(10) Patent No.: US 9,997,846 B1
(45) Date of Patent: Jun. 12, 2018

(54) WINDOW ELECTRICAL TERMINALS

(71) Applicant: Ford Global Technologies, LLC, Dearborn, MI (US)

(72) Inventors: Stuart C. Salter, White Lake, MI (US); Tom F. Boettger, Dearborn, MI (US); Paul Kenneth Dellock, Northville, MI (US); Jennifer Ann Gauthier, Fenton, MI (US); David C. Allen, Farmington Hills, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 0 days. days.

(21) Appl. No.: 15/437,946

(22) Filed: Feb. 21, 2017

(51) Int. Cl.
*H01R 33/00* (2006.01)
*H01R 4/04* (2006.01)
*H01R 13/24* (2006.01)

(52) U.S. Cl.
CPC ..... *H01R 4/04* (2013.01); *H01R 13/245* (2013.01); *H01R 2201/26* (2013.01)

(58) Field of Classification Search
CPC ..... H01R 2201/26; H01R 2201/02
USPC ..... 439/34
See application file for complete search history.

(56) References Cited

U.S. PATENT DOCUMENTS 4,533,445 A 8/1985 Orio
4,999,136 A 3/1991 Su et al.
6,903,463 B1 6/2005 Takeichi et al.
7,663,561 B2 * 2/2010 Hisaeda ..... B32B 17/10036 343/713
8,007,286 B1 * 8/2011 Holec ..... H01R 4/02 439/65
8,866,145 B2 * 10/2014 Choi ..... H01L 27/3262 257/72
2003/0162415 A1 * 8/2003 Spaulding ..... B60J 1/02 439/34
2006/0105589 A1 * 5/2006 Ackerman ..... H01R 43/0207 439/34
2007/0105412 A1 * 5/2007 Hoepfner ..... C22C 1/002 439/83
2007/0224842 A1 * 9/2007 Hoepfner ..... H01R 4/02 439/34
2010/0277885 A1 11/2010 Tatsuzawa et al.
(Continued)

FOREIGN PATENT DOCUMENTS

CN 201947538 U 8/2011
JP 2849652 B2 1/1999

OTHER PUBLICATIONS

M.A. Uddin and H.P. Chan, Contact Resistance of Anisotropic Conductive Adhesive Film Based Flip-Chip on Glass Packages, 2011 Advanced Study Center Co Ltd.; Rev. Adv. Mater. Sci 27 (2011) 151-157; 7 pages.

*Primary Examiner* — Abdullah Riyami
*Assistant Examiner* — Thang Nguyen
(74) *Attorney, Agent, or Firm* — Jason Rogers; Price Heneveld LLP

(57) ABSTRACT

A vehicle includes a window defining an exterior surface and an interior surface. An electrical bus is positioned on the interior surface. An electrical component is positioned on the window and electrically coupled with the bus. An electrical terminal is positioned on the bus. A connector is electrically coupled with the bus. An adhesive is positioned between the connector and the electrical bus. A conformal coating is positioned over the connector and the adhesive.

19 Claims, 3 Drawing Sheets

(56) References Cited

U.S. PATENT DOCUMENTS

| | | | | |
|---|---|---|---|---|
| 2011/0109115 | A1 | 5/2011 | Yamada et al. | |
| 2013/0115830 | A1* | 5/2013 | Seifert | H01R 4/185 439/888 |
| 2015/0155646 | A1* | 6/2015 | Takeuchi | H01R 4/04 439/78 |
| 2015/0192715 | A1* | 7/2015 | Taguchi | G02B 5/208 349/98 |
| 2016/0303783 | A1* | 10/2016 | Koganezawa | B29C 45/14778 |
| 2017/0261830 | A1* | 9/2017 | Luten | B60R 1/025 |

* cited by examiner

WINDOW ELECTRICAL TERMINALS

FIELD OF THE INVENTION

The present invention generally relates to windows, and more particularly, to electrical connections for vehicle windows.

BACKGROUND OF THE INVENTION

Various windows of a vehicle incorporate electrical elements. Accordingly, new methods and structures for providing electrical power to these elements are desired.

SUMMARY OF THE INVENTION

According to one aspect of the present invention, a vehicle includes a window defining an exterior surface and an interior surface. An electrical bus is positioned on the interior surface. An electrical component is positioned on the window and electrically coupled with the bus. An electrical terminal is positioned on the bus. A connector is electrically coupled with the bus. An adhesive is positioned between the connector and the electrical bus. A conformal coating is positioned over the connector and the adhesive.

According to another aspect of the present invention, a vehicle includes a window defining an exterior surface and an interior surface. An electrical bus is positioned on the interior surface. An electrical terminal is positioned on the bus including a connector. A first adhesive and a second adhesive couple the connector to the bus. The second adhesive is electrically conductive. A conformal coating is positioned over the connector and the first and second adhesives.

According to yet another aspect of the present invention, a vehicle includes a window. An electrical bus is positioned on the window. An electrical terminal is positioned on the bus. A connector defines a spring tab. An adhesive couples the connector and bus. The adhesive defines a void through which the spring tab contacts the electrical bus.

These and other aspects, objects, and features of the present invention will be understood and appreciated by those skilled in the art upon studying the following specification, claims, and appended drawings.

BRIEF DESCRIPTION OF THE DRAWINGS

The following is a description of the figures in the accompanying drawings. The figures are not necessarily to scale, and certain features and certain views of the figures may be shown exaggerated in scale or in schematic in the interest of clarity and conciseness.

In the drawings.

DETAILED DESCRIPTION OF THE PREFERRED EMBODIMENTS

Additional features and advantages of the invention will be set forth in the detailed description which follows and will be apparent to those skilled in the art from the description, or recognized by practicing the invention as described in the following description, together with the claims and appended drawings.

Figure 1A:
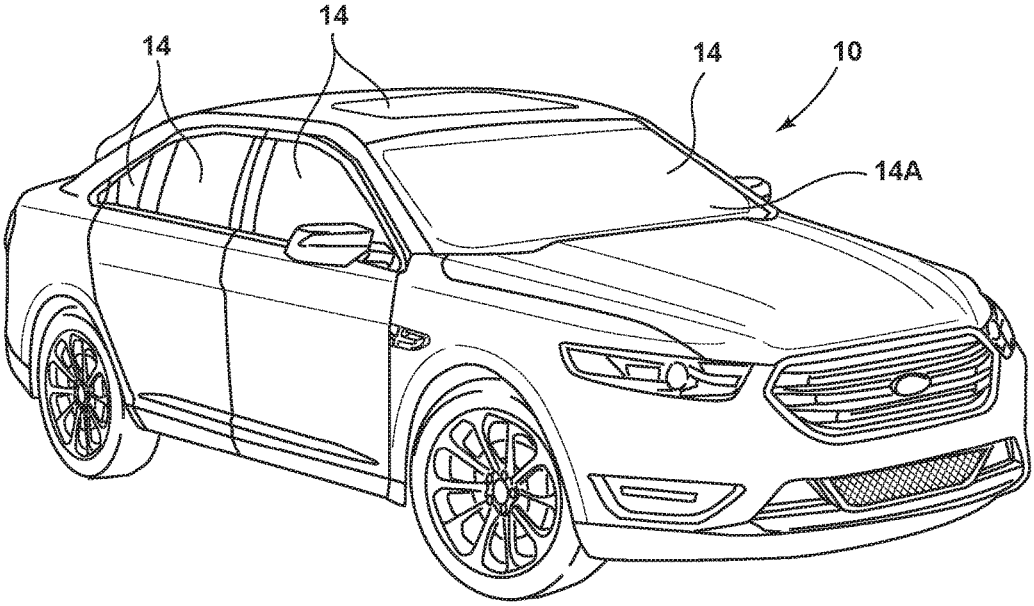
FIG. 1A is a perspective view of a vehicle, according to at least one example.
Figure 1B:
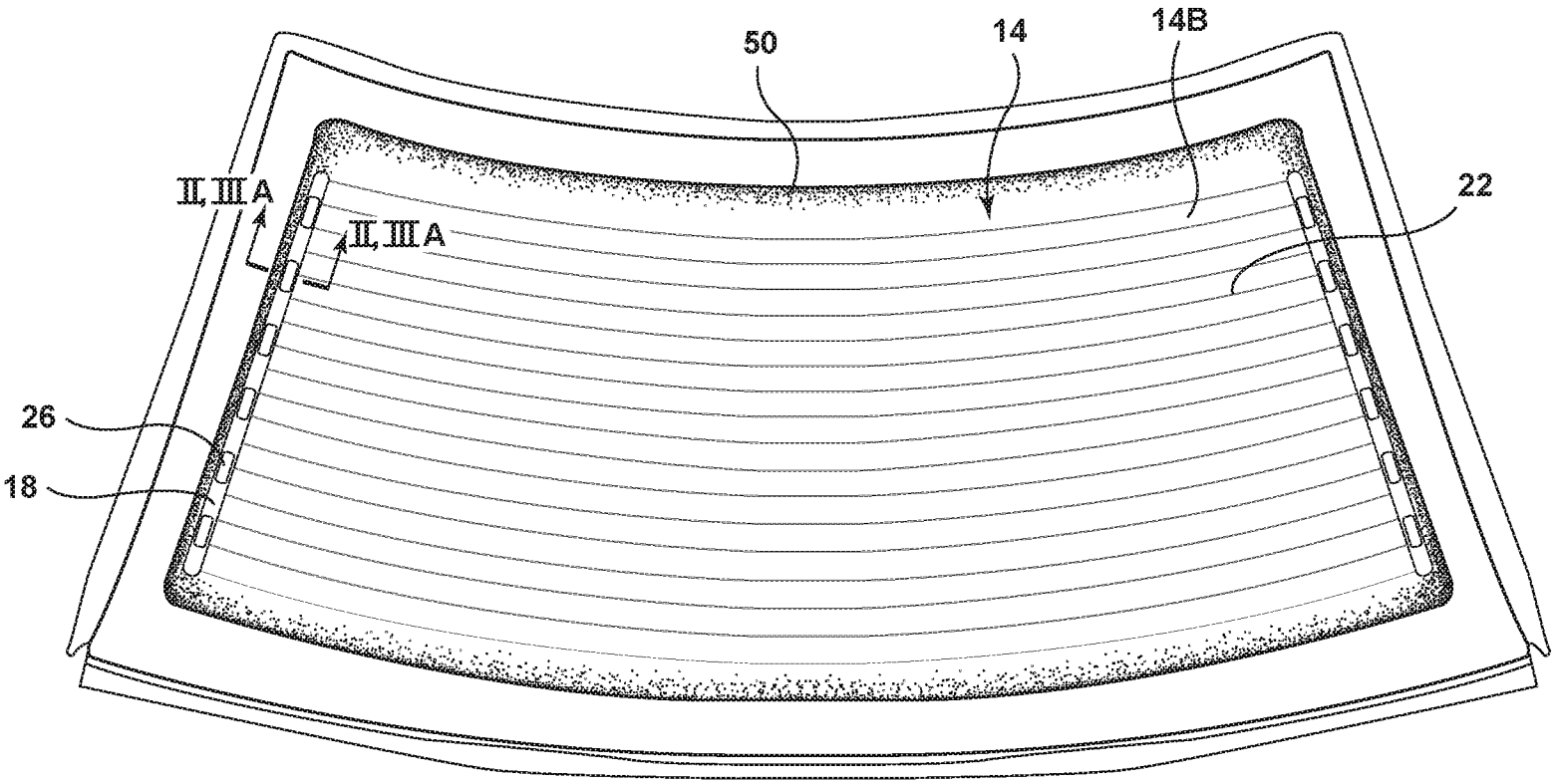
FIG. 1B is front elevational view of a vehicle window, according to at least one example.

For purposes of description herein, the terms "upper," "lower," "right," "left," "rear," "front," "vertical," "horizontal," and derivatives thereof shall relate to the disclosure as oriented in FIGS. 1A and 1B. However, it is to be understood that the invention may assume various alternative orientations, except where expressly specified to the contrary. It is also to be understood that the specific devices and processes illustrated in the attached drawings, and described in the following specification, are simply exemplary embodiments of the inventive concepts defined in the appended claims. Hence, specific dimensions and other physical characteristics relating to the embodiments disclosed herein are not to be considered as limiting, unless the claims expressly state otherwise.

As used herein, the term "and/or," when used in a list of two or more items, means that any one of the listed items can be employed by itself, or any combination of two or more of the listed items can be employed. For example, if a composition is described as containing components A, B, and/or C, the composition can contain A alone; B alone; C alone; A and B in combination; A and C in combination; B and C in combination; or A, B, and C in combination.

In this document, relational terms, such as first and second, top and bottom, and the like, are used solely to distinguish one entity or action from another entity or action, without necessarily requiring or implying any actual such relationship or order between such entities or actions.

Referring now to FIGS. 1A-3B, reference numeral 10 generally designates a vehicle. The vehicle 10 includes a window 14 defining an exterior surface 14A and interior surface 14B. An electrical bus 18 is positioned on the interior surface 14B. An electrical component 22 is positioned on the window 14 and is electrically coupled with the bus 18. An electrical terminal 26 is positioned on the bus 18. The electrical terminal 26 includes a connector 30 electrically coupled with the bus 18. A first adhesive 34 is positioned between the connector 30 and the electrical bus 18. A conformal coating 38 is positioned over the connector 30 and the first adhesive 34.

Referring now to FIG. 1, the vehicle 10 may include a plurality of windows 14. For example, the windows 14 may include a rearview window, a quarter window, side windows, a windshield, a moon roof and/or other transparencies positioned around the vehicle 10. The windows 14 may include a variety of functionalities such as heated park (e.g., to heat windshield wipers), defrost, heads-up displays, accent lighting, functional lighting as well as combinations thereof.

Figure 2:
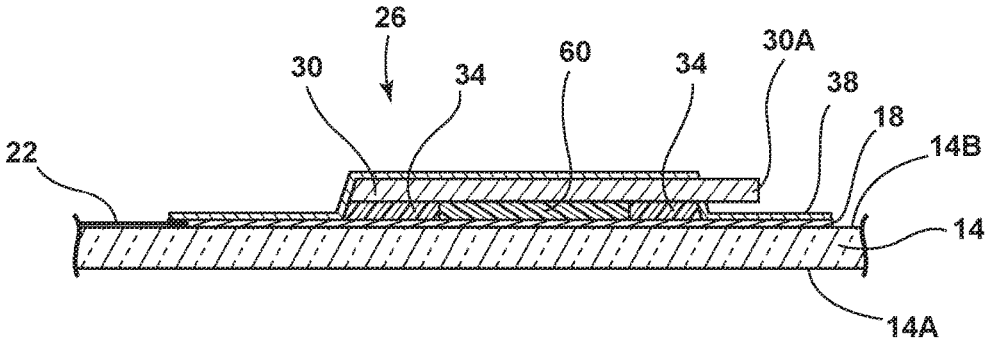
FIG. 2 is a cross-sectional view taken at line II of FIG. 1B, according to at least one example.

Referring now to FIG. 2, a rearview example of the window 14 is depicted including the interior surface 14B, and the exterior surface 14A (FIG. 1). The windows 14 may be formed from a glass, a polymeric material and/or combinations thereof. A frit 50 is positioned on the interior surface 14B of the window 14. The frit 50 may be used to block, partially or entirely, the passage of light through a portion of the windows 14 or can impart a color to the glass pane for decorative, aesthetic or functional purposes. In various examples, the frit 50 may be conductive such that the frit 50 may be used in conjunction with the electrical bus 18. The frit 50 may additionally and/or alternatively be used in vehicles 10 to protect an adhesive that bonds the glass to the vehicle 10 from the ultraviolet rays of the sun, to hide electrical wires and other hardware behind the glass, and also to provide a filter for the amount of sunlight allowed into the vehicle 10 such as "half tones" on the moon roof and certain backlights. For example, use of the frit 50 may be advantageous in obscuring a view of the electrical bus 18 when the window 14 is viewed from an exterior of the vehicle 10. It will be understood that the electrical bus 18 and/or the electrical terminals 26 may be obscured from view from an interior of the vehicle 10 using one or more fasciae and/or trim pieces. Further purposes of the frit 50 may include using the frit 50 to obscure a body opening, to block ultraviolet or infrared rays, as well as to provide graphic patterns to the vehicle 10. According to various examples, the frit 50 may be positioned between the interior surface 14B of the window 14 and the electrical bus 18. In other words, the electrical bus 18 may be positioned on the frit 50.

The electrical component 22 of the window 14 may be positioned on the interior surface 14B, the exterior surface 14A or within the window 14. For example, the window 14 may include two panes of transparent material (e.g., glass, plastic, etc.) with the electrical component 22 sandwiched therebetween. According to various examples, the electrical component 22 may be electrically coupled to, and configured to receive power from, the electrical bus 18. The electrical component 22 may include heater wires (e.g., for rear-defrost, front-defrost, windshield wiper defrost, etc.), an antenna (e.g., AM band, FM band, diversity antenna, etc.), a display (e.g., organic light emitting diode, liquid crystal, etc.), lighting elements and/or combinations thereof. In heater wire and antenna examples of the electrical component 22, the electrical component 22 may be formed of wires, transparent conductive oxides and/or combinations thereof. It will be understood that multiple separate electrical components 22 may be utilized on and in the window 14 without departing from the teachings provided herein. In some examples, each of the electrical components 22 may be powered by separate electrical buses 18. In other examples, the electrical components 22 may share a common electrical bus 18, but may instead have separate electrical terminals 26 electrically connected to separate electrical components 22.

As explained above, the window 14 may include a single or a plurality of electrical busses 18 positioned around the window 14. Although shown on sides of the window 14, it will be understood that electrical busses 18 may be positioned toward a top of the window 14, toward a bottom of the window 14, or anywhere therebetween. Positioning of the electrical busses 18 proximate a perimeter, or edge, of the window 14 may be advantageous in concealing the electrical busses 18 using the frit 50 and/or trim components. The electrical busses 18 may be formed of a conductive epoxy (e.g., silver, gold, platinum, copper laden epoxies), transparent conductive oxides (e.g., indium tin oxide), or may be formed from strips of a conductive material (e.g., silver, copper, gold, platinum, etc.). In examples where electrical busses 18 are formed from a conductive epoxy and/or transparent conductive oxides, the electrical busses 18 may be baked or fired onto the substrate of the window 14. The electrical busses 18 may have a width of between about 1 mm and about 10 mm, or between about 3 mm and about 6 mm. The electrical busses 18 may have a thickness of between about 1 μm and about 25 μm, or between about 8 μm and about 14 μm or between about 10 μm and about 12 μm after firing. The electrical busses 18 may include one or more alloying or tinting materials to aid in conductivity of the electrical busses 18. Each electrical bus 18 may include a single or a plurality of electrical terminals 26 as described above.

Still referring to the example depicted in FIG. 2, the electrical terminals 26 are positioned on the electrical bus 18. The electrical bus 18 may be polished or burnished at the locations where the electrical terminals 26 are placed. Polishing and/or burnishing of the electrical bus 18 prior to placement of the electrical terminals 26 may be advantageous in creating a greater bond or adhesion between the electrical terminals 26 and the electrical bus 18. In the depicted example, each of the electrical terminals 26 includes the connector 30, the first adhesive 34, a second adhesive 60 and the conformal coating 38. The connector 30 may be composed of a metal (e.g., copper, silver, platinum, gold etc.). The connector 30 may take a variety of shapes including square, rectangular, triangular, circular, oblong or higher order polygons. In the depicted example, the connector 30 defines a connector tab 30A which is configured to provide an access point for electrical energy to the electrical terminal 26. The connector tab 30A may be known as a pigtail connector. For example, a wire electrically coupled with an electrical system of the vehicle 10 may be crimped onto the connector tab 30A to provide electrical power to the electrical bus 18. The connector tab 30A may be thinner or thicker than the rest of the connector 30. Use of the connector tab 30A which is thicker than the connector 30 may be advantageous in providing an increased area with which to make an electrical connection to the electrical terminal 26 as well as reduce the likelihood of the connector tab 30A being damaged during connection. The connector tab 30A may protrude from a side of the electrical terminal 26 to extend outwards over the conformal coating 38 and the electrical bus 18. Although depicted as extending off to a side of the connector 30, the connector tab 30A may protrude at an angle or in perpendicularly upward direction from the connector 30 without departing from the teachings provided herein. The connector tab 30A may protrude from the conformal coating 38, or may be covered by the conformal coating 38 after an electrical connection (e.g., to the electrical system of the vehicle 10) to the connector tab 30A is made. In other words, the connector 30 and the connector tab 30A function as an attachment and transmission point for electrical energy to the electrical terminal 26. As such, the electrical terminal 26 is configured to transmit electrical energy to the electrical bus 18.

The first and second adhesives 34, 60 may cooperate to secure the connector 30 of the electrical terminal 26 to the electrical bus 18. The first adhesive 34 may extend proximate a perimeter of the connector 30. For example, the first adhesive 34 may extend around a portion, a majority or entirety of the connector 30. The first adhesive 34 may define a void in the center thereof. The void may be formed in the first adhesive 34 via an application method (e.g., dispensing the first adhesive 34 only proximate the perimeter of the connector 30) or may be formed via a post-processing technique (e.g., die cutting a hole or void into the first adhesive 34). The first adhesive 34 may have a height or thickness of between about 0.1 mm to about 2.0 mm, or between about 0.6 mm and about 1.5 mm. The first adhesive 34 may be formed of epoxies, urethanes, other adhesive chemicals and/or combinations thereof. According to various examples, the first adhesive 34 may be configured as a tape. In tape examples of the first adhesive 34, the first adhesive 34 may be known as a peel and stick tape in which a protective coating (e.g., plastic film, paper, etc.) is removed from the first adhesive 34 prior to the application to the electrical bus 18. Peel and stick tape examples of the first adhesive 34 may be advantageous in reducing manufacturing complexity as well as increasing repeatability of placement of the electrical terminal 26 on the electrical bus 18. Further, use of the tape examples of the first adhesive 34 may be advantageous in allowing a precise forming of the void. The first adhesive 34 may be activated or cured by the pressure and/or electromagnetically. In electromagnetically cured examples of the first adhesive 34, the electromagnetic radiation used may be ultraviolet light. In an exemplary application method of the electrical terminal 26 to the electrical bus 18, the protective coating of the first adhesive 34 may be removed, the first adhesive 34 may be cured (e.g., by shining ultraviolet light on the first adhesive 34), and the electrical terminal 26 may be pressed against the electrical bus 18 and rolled from one side to the other to ensure proper connection.

In the depicted example, the second adhesive 60 is positioned within the void defined by the first adhesive 34. In alternative examples, the first and second adhesives 34, 60 may be configured in a striped pattern, or in other configurations allowing sufficient retaining power from the first adhesive 34 and conductivity from the second adhesives 60. The relative volumetric proportions of the first adhesive 34 to the second adhesive 60 may be about 1/99, 10/90, 20/80, 30/70, 40/60, 50/50, 60/40, 70/30, 80/20, 99/1, respectively, and all values therebetween. As explained above, the first adhesive 34 may substantially surround the second adhesive 60. Such an example may be advantageous in protecting the second adhesive 60 from environmental damage (e.g., due to water, sulfur, dirt, grime present within the vehicle 10) which may lead to tarnishing or loss conductivity of the second adhesive 60. The second adhesives 60 may be composed of a metal laden epoxy (e.g., silver, gold, copper, platinum, etc.) and/or other conductive epoxies and adhesives. Epoxy examples of the second adhesive 60 may be advantageous in contributing to the retaining power of the electrical terminal 26 to the electrical bus 18.

According to various examples, application of the electrical terminal 26 to the electrical bus 18 may not compress, or only nominally compress the second adhesive 60. In other words, the second adhesive 60 may exhibit no residual compressive stress, nominal compressive stress, or minimal compressive stress. For example, the second adhesive 60 may be compressed against the electrical bus 18 only so much as to ensure an adequate electrical connection between the connector 30 and the electrical bus 18. The second adhesive 60, when applied to the connector 30 may be substantially flush with the first adhesive 34 along the first and second adhesive's 34, 60 interface with the electrical bus 18. As the second adhesive 60 is only nominally or not compressed during the application of the electrical terminal 26 to the electrical bus 18, the second adhesive 60 may have an initial height, or thickness, which is substantially (e.g., less than or equal to about 10%, about 9%, about 8%, about 7%, about 6%, about 5%, about 4%, about 3%, about 2%, about 1% or less than or equal to about 0.5%) the same as a final thickness after application of the electrical terminal 26 to the electrical bus 18. Further, the volume of the second adhesive 60 may remain substantially unchanged between pre-application and post-application of the electrical terminal 26 to the electrical bus 18.

The conformal coating 38 is positioned over the connector 30 and the first and second adhesives 34, 60 and may extend onto the electrical bus 18. The conformal coating 38 may be composed of a polymeric and/or elastomeric material (e.g., acrylic resin, epoxy resin, or urethane resin). The polymeric and/or elastic material allows the conformal coating 38 to take the shape of the electrical terminal 26. The conformal coating 38 may be composed of material which is transparent, translucent or opaque. The conformal coating may have a thickness of between about 10 μm and about 500 μm or between about 25 μm about 250 μm. The conformal coating 38 may be applied using brush coating, spray coating, dipping or other application methods. The conformal coating 38 may be cured or dried using heating (e.g., in a furnace) and/or may use electromagnetic radiation (e.g., ultraviolet light). Use of the conformal coating 38 may be advantageous in providing protection against moisture, dust, chemicals and temperature extremes that its uncoated, could result in damage or failure of the electrical terminal 26.

Figure 3A:
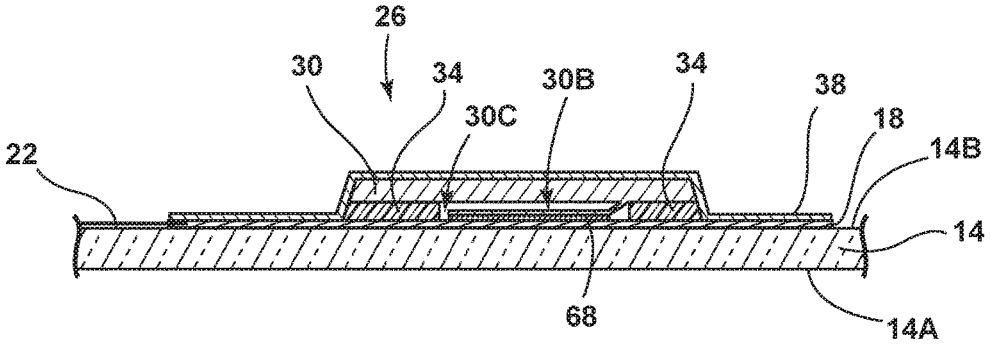
FIG. 3A is a cross-sectional view taken at line IIIA of FIG. 1B, according to at least one example.
Figure 3B:
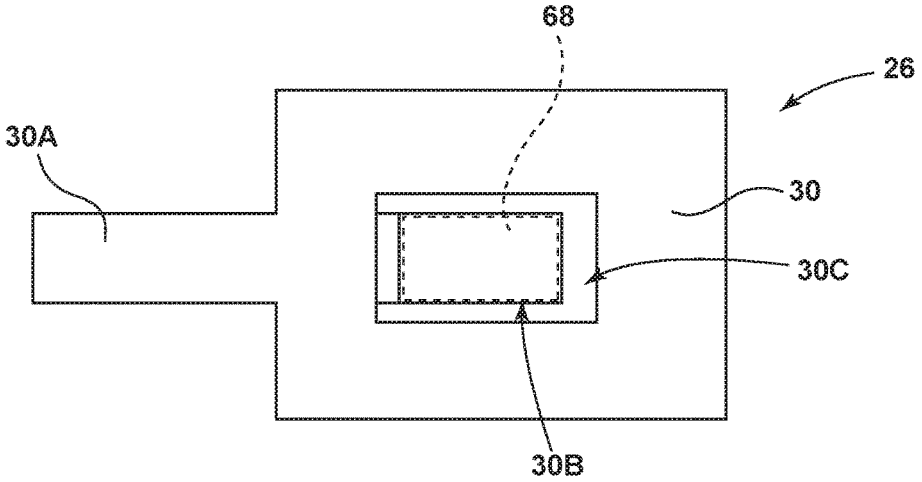
FIG. 3B is a top plan view of a connector, according to at least one example.

Referring now to FIGS. 3A and 3B, in the depicted example of the electrical terminal 26, the connector 30 integrally defines a spring tab 30B. In such an example, the first adhesive 34 may still be utilized in coupling and securing the connector 30 to the electrical bus 18. As before, the first adhesive 34 defines a void through which the spring tab 30B contacts the electrical bus 18. In the depicted example, the spring tab 30B extends downward toward the interior surface 14B of the window 14 to contact the electrical bus 18. The connector 30 may define a gap 30C positioned around the spring tab 30B or the spring tab 30B may be substantially flush or in line with the rest of the connector 30. The spring tab 30B is depicted as defined proximate a center of the connector 30, but it will be understood that the spring tab 30B may be positioned anywhere on the connector 30. An electrical contact 68 is positioned on spring tab 30B proximate the electrical bus 18. The electrical contact 68 is configured to electrically couple the spring tab 30B to the electrical bus 18. The electrical contact 68 may include a conductive metal such as gold, silver, platinum, copper and/or combinations thereof. Use of the spring tab 30B may be advantageous in providing force to electrically couple the electrical contact 68 to the electrical bus 18. It will be understood that the force provided by the spring tab 30B may be less than the adhesion force provided by the first adhesive 34. In examples utilizing the spring tab 30B, electrical energy may travel through the spring tab 30B to enter or exit the electrical bus 18.

Use of the present disclosure may offer a variety of advantages. First, use of ultraviolet curable and peel and stick examples of the first adhesive 34 may ease manufacturing time and cost associated with positioning electrical terminal 26 on the electrical bus 18. Second, use of adhesives to secure the electrical terminals 26 to the electrical bus 18 may provide for the elimination of the use of leaded solders to connect the electrical terminals 26 to the electrical bus 18. Third, use of the conformal coating 38 may protect the electrical terminals 26 from environmental exposure within the vehicle 10. Fourth, use of spring tab 30B examples of the connector 30 allows for a robust and secure connection between the connector 30 and the electrical bus 18. Fifth, use of the first and second adhesives 34, 60 allow for greater retention of the connector 30 at high temperatures (e.g., from sun light falling on the frit 50) than solders. Sixth, by removing soldering (i.e., which may require elevated temperatures) from the electrical terminals 26, glass cracking (e.g., of the window 14) due to localized heating may be reduced and/or eliminated.

According to various embodiments, a vehicle includes a window defining an exterior surface and an interior surface. An electrical bus is positioned on the interior surface. An electrical component is positioned on the window and electrically coupled with the bus. An electrical terminal is positioned on the bus. A connector is electrically coupled with the bus. An adhesive is positioned between the connector and the electrical bus. A conformal coating is positioned over the connector and the adhesive. Embodiments of the vehicle can include any one or a combination of the following features:

the connector defines a connector tab;

the connector comprises a metal;

the electrical component is a heater wire;

the electrical component is an antenna;

the adhesive extends proximate a perimeter of the connector;

a frit is positioned between the interior surface of the window and the electrical bus;

a plurality of electrical terminals are positioned on the electrical bus;

the adhesive is conductive;

the conformal coating extends onto the electrical bus;

the electrical terminal is configured to transmit electrical energy to the electrical bus; and the connector defines a spring tab.

Modifications of the disclosure will occur to those skilled in the art and to those who make or use the disclosure. Therefore, it is understood that the embodiments shown in the drawings and described above are merely for illustrative purposes and not intended to limit the scope of the disclosure, which is defined by the following claims, as interpreted according to the principles of patent law, including the doctrine of equivalents.

For purposes of this disclosure, the term "coupled" (in all of its forms: couple, coupling, coupled, etc.) generally means the joining of two components (electrical or mechanical) directly or indirectly to one another. Such joining may be stationary in nature or movable in nature. Such joining may be achieved with the two components (electrical or mechanical) and any additional intermediate members being integrally formed as a single unitary body with one another or with the two components. Such joining may be permanent in nature, or may be removable or releasable in nature, unless otherwise stated.

As used herein, the term "about" means that amounts, sizes, formulations, parameters, and other quantities and characteristics are not and need not be exact, but may be approximate and/or larger or smaller, as desired, reflecting tolerances, conversion factors, rounding off, measurement error and the like, and other factors known to those of skill in the art. When the term "about" is used in describing a value or an end-point of a range, the disclosure should be understood to include the specific value or end-point referred to. Whether or not a numerical value or end-point of a range in the specification recites "about," the numerical value or end-point of a range is intended to include two embodiments: one modified by "about," and one not modified by "about." It will be further understood that the endpoints of each of the ranges are significant both in relation to the other endpoint, and independently of the other endpoint.

The terms "substantial," "substantially," and variations thereof as used herein are intended to note that a described feature is equal or approximately equal to a value or description. For example, a "substantially planar" surface is intended to denote a surface that is planar or approximately planar. Moreover, "substantially" is intended to denote that two values are equal or approximately equal. In some embodiments, "substantially" may denote values within about 10% of each other, such as within about 5% of each other, or within about 2% of each other.

As used herein the terms "the," "a," or "an," mean "at least one," and should not be limited to "only one" unless explicitly indicated to the contrary. Thus, for example, reference to "a component" includes embodiments having two or more such components unless the context clearly indicates otherwise.

What is claimed is:

1. A vehicle, comprising:

a window defining an exterior surface and an interior surface;

an electrical bus positioned on the interior surface;

an electrical component positioned on the window and electrically coupled with the electrical bus; and an electrical terminal positioned on the electrical bus, comprising:

a connector electrically coupled with the electrical bus;

a first adhesive positioned around a perimeter of a second adhesive, wherein the first and second adhesives are positioned between the connector and the electrical bus; and a conformal coating positioned over the connector and the adhesive.

2. The vehicle of claim 1, wherein the connector defines a connector tab.

3. The vehicle of claim 2, wherein the connector comprises a metal.

4. The vehicle of claim 1, wherein the electrical component is a heater wire.

5. The vehicle of claim 1, wherein the electrical component is an antenna.

6. The vehicle of claim 1, wherein the first adhesive extends proximate a perimeter of the connector.

7. The vehicle of claim 1, further comprising:

a frit positioned between the interior surface of the window and the electrical bus.

8. The vehicle of claim 1, wherein a plurality of electrical terminals are positioned on the electrical bus.

9. A vehicle, comprising:

a window defining an exterior surface and an interior surface;

an electrical bus positioned on the interior surface; and an electrical terminal positioned on the electrical bus, comprising:

a connector;

a first adhesive and a second adhesive coupling the connector to the electrical bus, wherein the second adhesive is electrically conductive; and a conformal coating positioned over the connector and the first and second adhesives wherein the first adhesive substantially surrounds the second adhesive.

10. The vehicle of claim 9, wherein the first adhesive is ultraviolet curable.

11. The vehicle of claim 10, wherein the conformal coating extends onto the electrical bus.

12. The vehicle of claim 9, wherein the electrical terminal is configured to transmit electrical energy to the electrical bus.

13. A vehicle, comprising:

a window;

an electrical bus positioned on the window; and an electrical terminal positioned on the electrical bus, comprising:

a connector defining a spring tab; and an adhesive coupling the connector and electrical bus, wherein the adhesive defines a void through which the spring tab contacts the electrical bus.

14. The vehicle of claim 13, further comprising:

a conformal coating extending over the connector, the adhesive and the electrical bus.

15. The vehicle of claim 14, wherein the spring tab is defined proximate a center of the connector.

16. The vehicle of claim 15, further comprising:

an electrical contact coupling the spring tab and the electrical bus.

17. The vehicle of claim 16, wherein the electrical contact comprises at least one of gold, silver, platinum and copper.

18. The vehicle of claim 17, wherein the spring tab extends toward an interior surface of the window.

19. The vehicle of claim 18, wherein the adhesive is electromagnetically curable.

* * * * *